US006743764B1

(12) United States Patent
Wallick et al.

(10) Patent No.: US 6,743,764 B1
(45) Date of Patent: Jun. 1, 2004

(54) LOW VISCOSITY ALKYL DIPHENYL OXIDE SULFONIC ACID BLENDS

(75) Inventors: David E. Wallick, Midland, MI (US); Timothy J. Gallagher, Midland, MI (US)

(73) Assignee: Dow Global Technologies Inc., Midland ( * ) Notice: Subject to any disclaimer, the term of this patent is extended or adjusted under 35 U.S.C. 154(b) by 812 days.

(21) Appl. No.: 09/608,585

(22) Filed: Jun. 30, 2000

Related U.S. Application Data

(60) Provisional application No. 60/146,395, filed on Jul. 30, 1999.

(51) Int. Cl.[7] ..... C11D 1/04; C11D 1/24; C11D 7/34; C11D 9/32

(52) U.S. Cl. ..... 510/414; 510/426; 510/428; 510/437; 252/182.3; 252/182.31

(58) Field of Search ..... 252/182.3, 182.31; 510/414, 432, 426, 427, 428, 430, 437; 568/28, 33

(56) References Cited

U.S. PATENT DOCUMENTS

| | | | | |
|---|---|---|---|---|
| 2,854,477 A | | 9/1958 | Steinhauer | 260/512 |
| 2,990,375 A | | 6/1961 | Steinhauer et al. | 252/138 |
| 3,027,223 A | | 3/1962 | Teot | 8/125 |
| 3,264,242 A | | 8/1966 | Teot | 260/29.6 |
| 3,634,272 A | | 1/1972 | Valenta et al. | 252/153 |
| 3,645,906 A | | 2/1972 | Valenta et al. | 252/171 |
| 3,945,437 A | | 3/1976 | Chiu et al. | 166/305 |
| 3,969,258 A | | 7/1976 | Carandang et al. | 252/106 |
| 4,013,569 A | | 3/1977 | Chiu et al. | 252/8.55 |
| 4,106,901 A | | 8/1978 | Bishop et al. | 8/139 |
| 4,135,878 A | | 1/1979 | Bishop et al. | 8/139 |
| 4,269,749 A | | 5/1981 | Marriott et al. | 260/29.6 |
| 4,287,077 A | | 9/1981 | Wing | 252/75 |
| 4,581,042 A | * | 4/1986 | Willmore | 51/293 |
| 4,645,623 A | | 2/1987 | Dolan et al. | 252/558 |

(List continued on next page.)

FOREIGN PATENT DOCUMENTS

| | | |
|---|---|---|
| AU | 9640857 | 1/1997 |
| CA | 2050627 | 3/1992 |
| DE | 3634644 | 4/1987 |
| EP | 875551 | 11/1998 |
| WO | WO 94/05759 | 3/1994 |

OTHER PUBLICATIONS

Carter, Tracee et al., "Increasing the Soluability Enhancement of Anionic DOWFAX Surfactants," Separation Science and Technology, 33(15), pp. 2363–2377, 1998.

"More Solutions to Sticky Problems—A Guide to Getting More from Your Brookfield Viscometer," Brookfield Engineering Laboratories, Inc., Jul., 1996.

"Chapter 9—Rheology,"in Shaw, Duncan J., Introduction to Colloid and Surface Chemistry, 4th Edition, Butterworth–Heinemann Ltd., Oxford, UK (1992).

Boese, Roland; Hans–Christoph Weiss, and Dieter Blaser, "The Melting Point Alternation in the Short–Chain n–Alkanes: Single–Crystal X–Ray Analyses of Propane at 30 K and of n–Butane to n–Nonane at 90 K," Angew. Chem. Int. Ed., 38 (7), 988–992 (1999).

(List continued on next page.)

*Primary Examiner*—Joseph D. Anthony

(57) ABSTRACT

This invention addresses methods and compositions for providing alkyl diphenyl oxide sulfonic acid blends at useful viscosities for use in surfactants such as DOWFAX-containing surfactants. The low viscosity alkyl diphenyl oxide sulfonic acid blend is made by admixing a fatty acid having a carboxylic chain length between 1 and 12 (e.g., formic acid, acetic acid, propionic acid, butanoic acid, pentanoic acid, valeric acid, hexanoic acid, heptanoic acid, octanoic acid, nonanoic acid, decanoic acid, undecanoic acid, or dodecanoic acid into an alkyl diphenyl oxide sulfonic acid reaction product to provide between about 5 weight percentage and about 50 weight percentage of fatty acid in the admixture.

5 Claims, 4 Drawing Sheets

VISCOSITIES OF AQUEOUS DILUTIONS OF DOWFAX DETERGENT CONTAINING VARIOUS LEVELS OF OCTANOIC ACID ADDITIVE

U.S. PATENT DOCUMENTS

| | | | | | |
|---|---|---|---|---|---|
| 4,687,593 | A | | 8/1987 | Dolan et al. | 252/182 |
| 4,701,276 | A | | 10/1987 | Wyman | 252/62.52 |
| 4,757,833 | A | | 7/1988 | Danley | 137/13 |
| 4,800,036 | A | | 1/1989 | Rose et al. | 252/102 |
| 4,806,256 | A | | 2/1989 | Rose et al. | 252/71 |
| 4,820,429 | A | | 4/1989 | Lim | 252/8.554 |
| 4,950,424 | A | | 8/1990 | van der Hoeven et al. | 252/540 |
| 4,975,110 | A | | 12/1990 | Puritch et al. | 71/113 |
| 5,000,262 | A | | 3/1991 | Danzik | 166/272 |
| 5,015,367 | A | | 5/1991 | Klimpel et al. | 209/166 |
| 5,085,789 | A | | 2/1992 | Yokouchi et al. | 252/62.52 |
| 5,106,410 | A | * | 4/1992 | Puritch et al. | 504/142 |
| 5,136,088 | A | | 8/1992 | Farmer et al. | 562/88 |
| 5,203,411 | A | | 4/1993 | Dawe et al. | 166/274 |
| 5,273,682 | A | | 12/1993 | Danzik | 252/320 |
| 5,298,529 | A | | 3/1994 | Narayanan | 514/788 |
| 5,366,995 | A | * | 11/1994 | Savage et al. | 514/558 |
| 5,373,064 | A | | 12/1994 | Konishi et al. | 525/357 |
| 5,585,341 | A | | 12/1996 | Van Eenam | 510/365 |
| 6,121,219 | A | * | 9/2000 | Herdt et al. | 510/218 |
| 6,136,856 | A | * | 10/2000 | Savage et al. | 514/552 |
| 6,472,358 | B1 | * | 10/2002 | Richter et al. | 510/234 |

OTHER PUBLICATIONS

Rosen, Milton J., Surfactants and Interfacial Phenomena, Second Edition, John Wiley & Sons, New York (1989).

Keenan, M. J. and M. A. Krevalis, "Carboxylic Acids (Survey)" in Kirk–Othmer Encyclopedia of Chemical Technology, 4$^{th}$ Edition, edited by Mary Howe–Grant Kroschwitz, John Wiley & Sons, New York (1992).

Sjoberg, Marie and Torbjorn Warnheim, "Nonaqueous Surfactant Systems," Surfactant Science Series vol. 67, pp. 179–205, edited by Kuo–Yann Lai, Marcel Dekker Inc., New York (1997).

Hoffman, Heinz and Werner Ulbricht, "Viscoelastic Surfactant Solutions," Surfactant Science Series vol. 70, pp. 285–324, edited by Kunio Esumi and Minoru Ueno, Marcel Dekker Inc. New York (1997).

Rounds, R. S., "Rheology of Liquid Detergents," Surfactant Science Series vol. 67, pp. 67–127, edited by Kuo–Yann Lai, Marcel Dekker Inc., New York (1997).

Hoffman, Heinz and Heinz Rehage, "Rheology of Surfactant Solutions," Surfactant Science Series vol. 22, pp. 209–239, edited by Raoul Zana, Marcel Dekker Inc., New York.

Nasr–El–Din, H.A., D. Schriemer, and A.S. Abd–El–Aziz, Chapter 11, "Liquid Crystal Formation and Its Effect on the Flow Properties of an Anionic Surfactant," in Dynamic Properties of Interfaces and Association Structures, pp. 206–230, edited by Vinod Pillai and D. O. Shah, AOCS Press, Champaign, Ill. (1996).

Lalanne–Cassou, C. et al., "Minimizing Cosolvent Requirements for Microemulsion Formed With Binary Surfactant Mixtures," J. Dispersion Science and Technology, 8(2), pp. 137–156, (1987).

"Supersolubilization in Mono– and Dialkyl Diphenyloxidedisulfonate Solutions," Presentation by Wu, Bin et al, University of Oklahoma, Sep. 9, 1998.

Loughney, T. J. et al., "The Determination of HLB and Solvent HLB Values for Mono and Dialkylated Mono and Disulfonated Diphenyl Oxides," World Surfactants Congr., 4$^{th}$ , 1996, 2, pp. 462–474.

CA 121:234426n, JP 06,172,773, Chiba, Tsunenori et al., "Lubricant Compositions Containing Alkylphenyl Ether Sulfonates for Polyalkylene Terephthalate Vessels".

Dawe, Bob et al., "Reduced Adsorption and Separation of Blended Surfactants on Sand and Clay", J. Can. Pet. Technol., 1991, 30(2), pp. 133–137.

Research Disclosure167077, Improved disulfonated surfactant compositions for enhanced oil recovery processes, Disclosed anonymously, Mar. 1978.

* cited by examiner

LOW VISCOSITY ALKYL DIPHENYL OXIDE SULFONIC ACID BLENDS

This application claims the benefit of U.S. Provisional Application No. 60/146,395, filed Jul. 30, 1999.

FIELD OF THE INVENTION

This invention is directed to surfactant materials and compositions and to methods for making concentrated intermediates with good handling properties.

BACKGROUND OF THE INVENTION

Rheological behavior is an important consideration in a liquid. An appropriate viscosity in a liquid product enables it to either be (a) usefully consumed as received or (b) conveniently received into a conditioning system for further adjustment of the viscosity to a useful value for the application. The utility of components used in a liquid blend is also affected by viscosity; and, in this regard, highly concentrated alkyl diphenyl oxide sulfonic acid as manufactured has a relatively high liquid viscosity. DOWFAX™ surfactants (DOWFAX is a trademark of The Dow Chemical Company) are good examples of products from alkyl diphenyl oxide sulfonic acids. Highly concentrated alkyl diphenyl oxide sulfonic acids have solids concentrations from about 60% to about 95% and are denoted as High Actives Acid, or HAA, herein. While the high viscosity can be moderated to acceptable levels with dilution in some HAAs, other HAAs (e.g. DOWFAX Detergent Acid) demonstrate an apparent liquid crystal region in the 40% to 80% solids range. The liquid crystal region is characterized by very high viscosity (greater than 1,000,000 centipoise) and the material is accordingly too viscous at temperatures below 40 degrees C. for convenient handling. When the material is heated to render the viscosity acceptably convenient, the material is unfortunately too hot for safe handling outside of relatively expensive blending environments optimized for safe operations at such temperatures. As noted previously, DOWFAX surfactants are good examples of products from alkyl diphenyl oxide sulfonic acids. DOWFAX surfactants have two ionic charges per molecule. Each molecule consists of a pair of sulfonate groups on a diphenyl oxide backbone. This double charge density is largely responsible for excellent solvating and coupling action in this molecular family. DOWFAX surfactants have excellent solubility and stability in concentrated electrolytes and are resistant to oxidative and thermal degradation. DOWFAX surfactants have hydrophobes of a linear or branched alkyl group comprised of from six to sixteen carbons, depending upon the particular surfactant. Example utility of DOWFAX surfactants is in textile dyeing, polymer emulsion processing, agricultural chemical manufacturing, and (as an additive) cleaning fluid formulating.

It has been desired for some time to be able to sell High Active Acid as a concentrated product for use in formulations prior to neutralization in order to minimize shipping and handling costs respective to the surfactant product water component; however, (a) the addition of water to HAA at room temperature has traditionally not been convenient because of the high viscosity of the HAA at room temperatures and (b) most customers for the surfactant product are not conveniently availed of a blending environment for safe handling of hot HAA. Speculated benefits, therefore, of efficiency in shipping and handling and the benefits in safety from an HAA which could be blended into water at room temperature have not been realized. What is needed is an HAA having a useful viscosity at room temperature which can be added to water. The present invention solves this problem by providing HAA formulation embodiments and methods for their formulation so that an HAA having a relatively low viscosity at room temperature is provided.

SUMMARY OF THE INVENTION

The room temperature viscosity of an alkyl diphenyl oxide sulfonic acid blend is beneficially controlled according to the invention by admixing a fatty acid having a carboxylic chain length between 1 and 12 into the alkyl diphenyl oxide sulfonic acid blend to provide between about 5 weight percentage and about 50 weight percentage of fatty acid in the admixture.

DETAILED DESCRIPTION OF THE PREFERRED EMBODIMENTS

Figure 1:
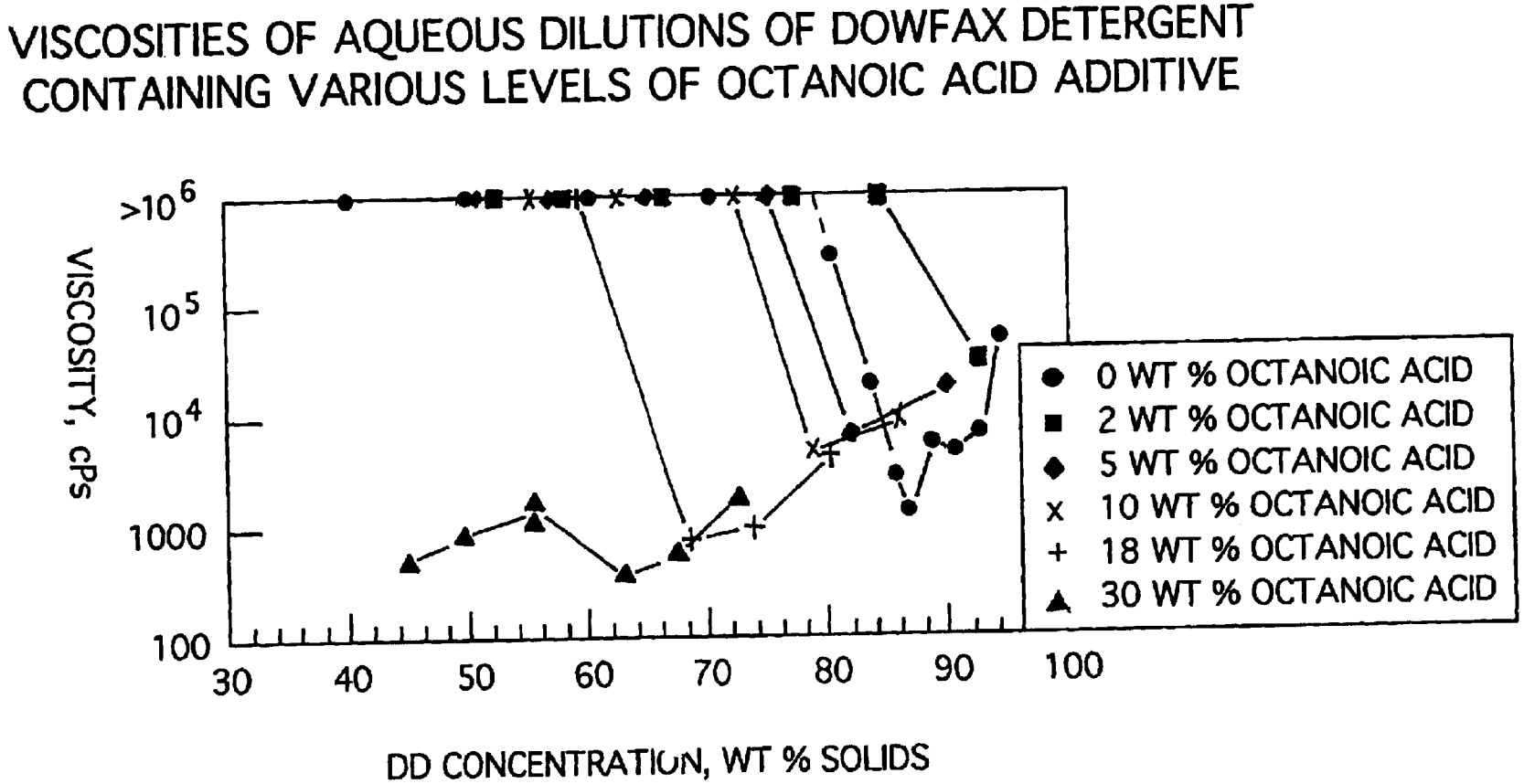
FIG. 1 shows the impact of various levels of octanoic acid upon the viscosity of a DOWFAX alkyl diphenyl oxide sulfonic acid surfactant blend.

Alkyl diphenyl oxide sulfonate surfactants are a Friedel-Crafts reaction product of an olefin and diphenyl oxide using $AlCl_3$ as a catalyst as indicated in Formula I.

Formula I

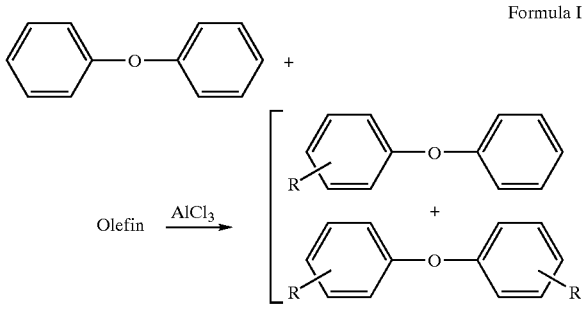

Diphenyl oxide is present in excess and is recycled. The reaction yields a mixture of monoalkyl diphenyl oxide and dialkyl diphenyl oxide. The ratio of monoalkylation to dialkylation can be optimized depending on the end use of the products.

The next step in the process is the reaction of the alkylate with a sulfonating agent. This reaction (Formula II) is conducted in a solvent to dilute the reactant and to act as a diluent for the $SO_3$ used in the reaction.

Formula II

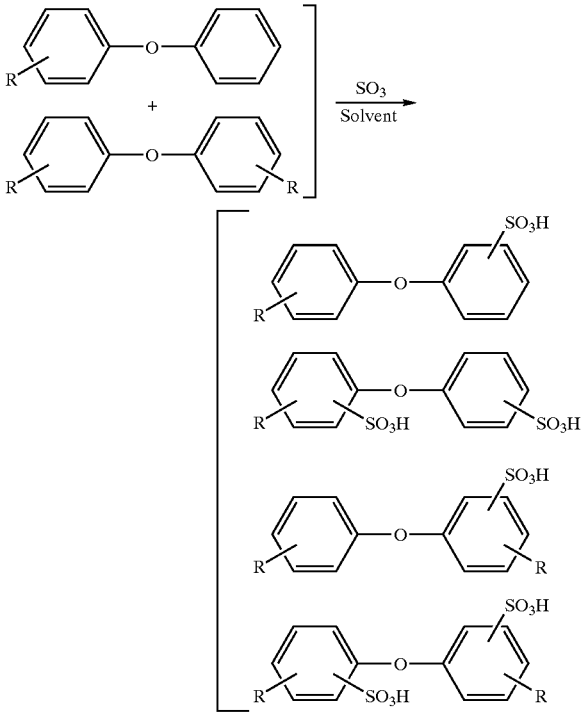

The reaction generally yields a mixture of monosulfonates and disulfonates according to Formulas III–VI. The level of disulfonation is determined by the end use of the product. Generally, the disulfonation level is above 80%. The predominant component in the commercial reaction mixture is the monoalkyl diphenyl oxide disulfonate (MADS) of Formula IV, with monoalkyl diphenyl oxide monosulfonate (MAMS) of Formula III, dialkyl diphenyl oxide monosulfonate (DAMS) of Formula V, and dialkyl diphenyl oxide disulfonate (DADS) of Formula VI essentially providing the remainder.

Formula III

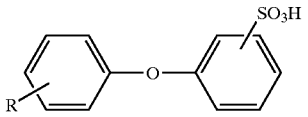

Formula IV

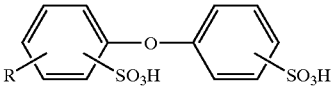

Formula V

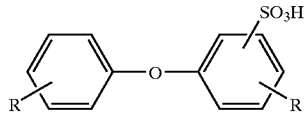

Formula VI

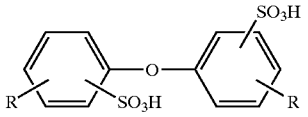

Alkyl diphenyloxide sulfonates and their traditional methods of preparation are well-known and reference is made thereto for purposes of describing this invention. Representative methods of preparation and handling are disclosed in U.S. Pat. Nos. 2,990,375; 3,264,242, 3,634,272; 3,945,437; and 5,015,367 which are each hereby incorporated by reference. The commercially available species are predominantly (greater than 85 percent) disulfonates (the DADS and MADS described above) and are a mixture of mono- and di-alkyl with the percentage of dialkylation (the DADS and DAMS described above) being about 5 to about 25 and the percentage of monoalkylation (the MAMS and MADS described above) being about 75 to 95 percent. Most typically, the commercially available species are about 85 percent monoalkyl and 15 percent dialkyl.

The traditional method taught by Steinhauer et al. (U.S. Pat. No. 2,990,375) outlines a series of steps, the first step comprising preparing an alkyldiphenyl ether by reacting an olefin or an olefin halide, such as tripropylenes, tetrapropylenes, pentapropylenes or dodecyl bromide, with diphenyl ether at a temperature between about 50° C. and about 100° C. in the presence of the Friedel-Crafts catalyst. The reaction mixture is washed with water to remove the catalyst, the phases separated, and the organic-rich phase subjected to distillation to obtain a fraction consisting of a mixture of monoalkylated diphenyl ether and dialkylated diphenyl ether. The number of alkyl substituents per diphenyl ether molecule can be controlled by adjusting the relative proportions of the reactants. Alternatively, the distillation can be performed so as to separate the monoalkylated and dialkylated diphenyl ethers from one another and from lower or higher boiling ingredients after which the monoalkylated and dialkylated diphenyl ether fractions can be combined at a desirable ratio.

The mixture of monoalkylated and dialkylated diphenyl ethers is subsequently reacted with a sulfonating agent, such as chlorosulfonic acid, sulfuric acid, or sulfur trioxide, in an inert solvent.

The general process of today uses reaction of an unsaturated hydrocarbon such as an alpha-olefin in the range of 6 to 16 carbons with diphenyl oxide in the presence of $AlCl_3$. Reaction of alpha-olefins in the higher range of 18–30 carbons with diphenyl oxide in the presence of $AlCl_3$ holds some promise for fulfilling future surfactant needs. The ratio of mono- to dialkylation is controlled by the ratio of olefin to diphenyl oxide. Recycled excess diphenyl oxide is purified and reused. The rate of the reaction and the yield are controlled by the amount of catalyst and temperature of the alkylation. Excessively high temperatures as well as excessive amounts of catalyst yield higher levels of dialkylation and trialkylation. Low temperatures result in a low conversion of olefin. The ratios of concentration, catalyst and temperature are critical in keeping the reaction products consistent throughout the production cycle. The catalyst is removed from the process stream and the crude reaction mixture is then stripped of excess diphenyl oxide. Additional purification is optionally effected prior to the sulfonation reaction.

Sulfonation is generally carried out in a solvent. The solvent provides value in distributing the sulfonating agent, preventing localized burning and yield loss of the reaction product, and acting as a heat removal medium in control of the reaction process temperature. Current commercial process routes use sulfur dioxide, methylene chloride, or air as reaction solvents. The air sulfonation process eliminates the need for the removal and recycle of the liquid reaction solvent and is amenable to onsite generation of $SO_3$. Liquid solvents require the use of liquid $SO_3$ that is diluted into the solvent prior to addition to the sulfonation reactors. Sulfur trioxide and chlorosulfonic acid are the two most common sulfonating agents.

After sulfonation, (1) the sulfonic acid is separated from its diluent, (2) the anhydrous acid (HAA) is diluted with water, and (3) neutralization of the diluted acid is optionally executed with an alkaline base such as sodium hydroxide. The material is packaged and sold in drums or bulk shipments as the customer requires.

The high viscosity of concentrated HAA derives from properties related to liquid crystal presence. This effect initiates at hydrophobe chain lengths above 6, is increasingly pronounced in observed samples to chain lengths of 16, and is expected to extend with greater significance to cases such as those which are contemplated via reaction of alpha-olefins in the higher range of 18–30 carbons with diphenyl oxide. Accordingly, a liquid crystal disrupter, or crystal structure breaker, is highly desirable as an additive for enabling useful viscosity in a useful HAA solids region (i.e. in an 60–95% solids range). In this regard, an additional component in the blend is most desirable which disrupts High Actives Acid (HAA) liquid crystal structure without imparting undesirable attributes to the resulting blend. In this regard, dimethylformamide (DMF) and methyl formamide (MF) effectively disrupt the liquid crystal structure in alkyl diphenyl oxide sulfonic acid blends used in deriving DOWFAX surfactants; but DMF and MF are not favored for use because of asserted health concerns.

It has been discovered that addition of fatty acids, for instance, caprylic (octanoic) or lauric acid, to highly concentrated surfactant sulfonic acid can greatly reduce the surfactant viscosity and improve handling characteristics of HAA. The use of such an additive to form particular blends enables the manufacture and use of concentrated acid forms of these surfactants.

In an alternative embodiment, admixing the fatty acid with the alkyl diphenyl oxide prior to sulfonation also provides reduction of surfactant viscosity and improved handling characteristics in the HAA material.

Formic acid, acetic acid, propionic acid, butanoic acid, pentanoic acid, valeric acid, hexanoic acid, heptanoic acid, octanoic acid, nonanoic acid, decanoic acid, undecanoic acid, and dodecanoic (lauric) acid all provide benefit in low viscosity HAA formulations as further described with reference to the sample data in the Examples and Figures.

EXAMPLE 1

Samples containing straight-chain carboxylic acids from formic to lauric acid were blended with a representative alkyl diphenyl oxide sulfonic acid surfactant with a 16-carbon hydrophobe side chain (DOWFAX Detergent Acid, 94 wt % concentration) at levels of 10 wt % carboxylic acid based upon DOWFAX amount. The viscosities of these samples were measured at 40° C. The results are listed in Table 1.

Method for Measuring Viscosity

A Brookfield programmable rheometer, Model HDAV-III, was used to measure the viscosity of DOWFAX acid samples. The spindle size used was SC4-21. The viscosities of the samples were measured at 40° C., a temperature at which the Thermosel temperature control stage was stable.

Approximately 8 mLs of sample were placed into the rheometer chamber. The spindle was inserted into the chamber so that the sample covered to ⅛ inch of the spindle shaft. The chamber was placed into the temperature control stage and the spindle connected to the rheometer. The rheometer was auto-zeroed. Stirring was started at 1 RPM and the sample was allowed to temperature equilibrate for ten minutes. After the ten minutes, the motor was stopped, the sample was allowed to sit for five minutes, then the motor was started again. A reading was taken after the spindle made 5 revolutions. The stirring was increased and the torque recorded until the allowable torque range on the instrument was exceeded. The equation below was used to convert torque to viscosity in units of cP:

Viscosity=100/RPM*TK*SMC*Torque

Torque constant (TK)=2

Spindle Multiply Constant (SMC)=5

TABLE 1

Structure - Viscosity Modification Attributes of Carboxylic Acid Additives in DOWFAX Detergent Surfactant [9.1 wt % carboxylic acid, 85.5 wt % DOWFAX Detergent, 5.4 wt % water]

| Carboxylic Acid Common | (Systematic) | Viscosity, cP (@ 40.8° C.) |
|---|---|---|
| Formic | (methanoic) | 7030 |
| Acetic | (ethanoic) | 5847 |
| Propanoic | (propanoic) | 4965 |
| Butyric | (butanoic) | 5227 |
| Valeric | (pentanoic) | 4970 |
| Caproic | (hexanoic) | 6333 |
| Enanthic | (heptanoic) | 6290 |
| Caprylic | (octanoic) | 9360 |
| Pelargonic | (nonanoic) | 9120 |
| Capric | (decanoic) | 15820 |
| Lauric | (dodecanoic) | 18040 |

EXAMPLE 2

Samples containing a variety of concentrations (from 2 to 50 wt % based upon DOWFAX acid amount) of a representative carboxylic acid, octanoic acid, were blended with a representative alkyl diphenyl oxide sulfonic acid surfactant with a 16-carbon hydrophobe side chain (DOWFAX Detergent Acid, or DD-HAA in FIGS. 1 and 2) at a variety of aqueous dilution levels (from 44 to 94 wt % DOWFAX acid). Each sample was blended until homogeneous. The viscosities of these samples were measured at 40° C. by the method indicated in Example 1. The results of these measurements are shown in FIGS. 1 and 2.

Some of the samples (a) exhibited liquid crystal behavior with very high viscosities and (b) turned solid-like in consistency. These samples typically exhibited viscosities exceeding the upper measuring limit of the rheometer (1,000,000 cP), and these samples are shown as having viscosities of 1,000,000 cP in the Figures. The behavior of DOWFAX Detergent Acid containing no carboxylic acid ("0 wt % OA") is shown for comparison purposes in both FIGS. 1 and 2.

Figure 2:
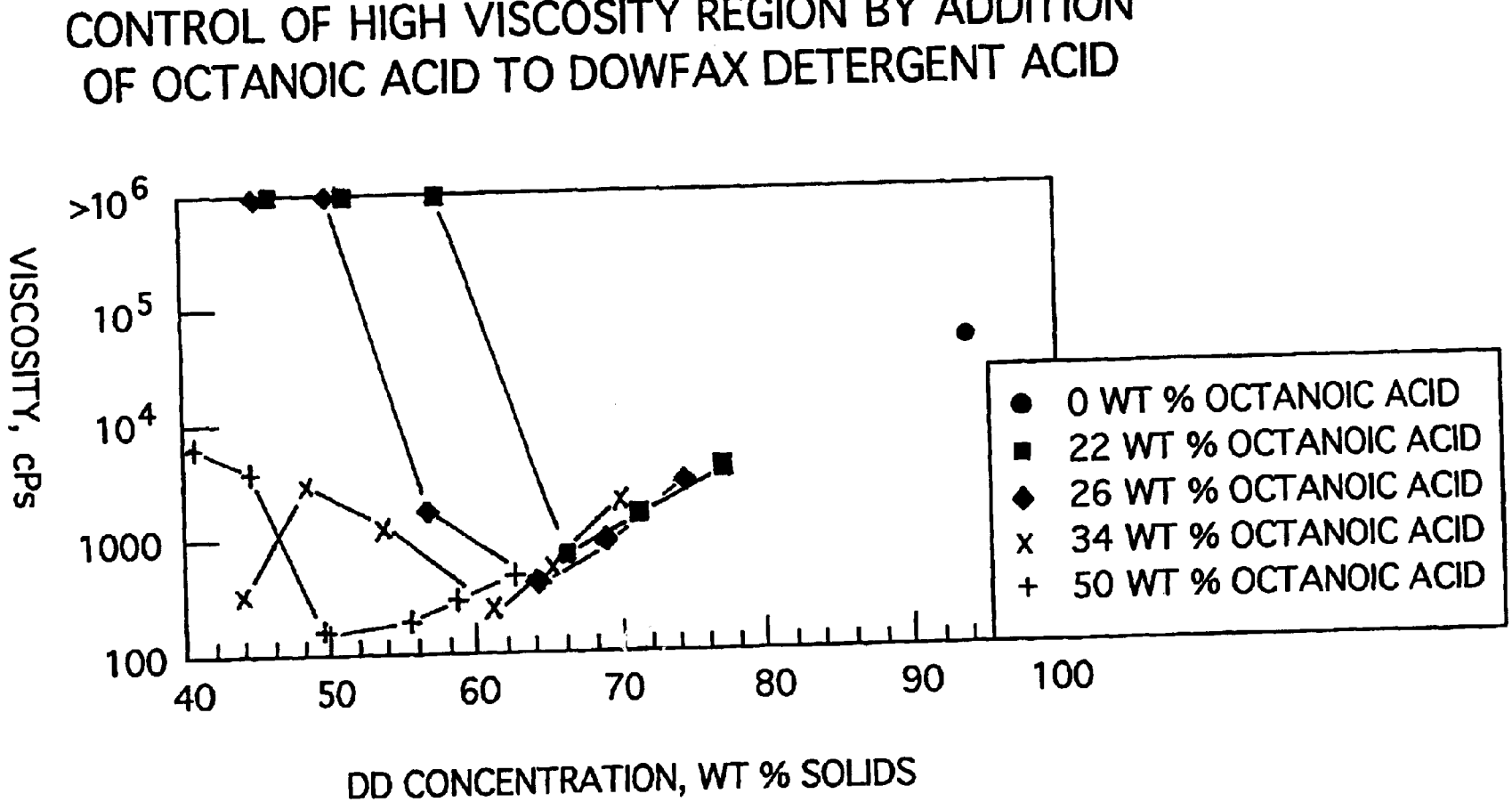
FIG. 2 shows the impact of various levels of octanoic acid upon the viscosity of a DOWFAX alkyl diphenyl oxide sulfonic acid surfactant blend in the high viscosity range.

The onset of the liquid crystal phase in FIG. 1 is apparent at the rapid rise of viscosity with decrease of solids in the 69% to 90% solids range (depending on the particular concentration of octanoic acid). Only at 30% octanoic acid is the liquid crystal phase evidently suppressed.

EXAMPLE 3

Figure 3:
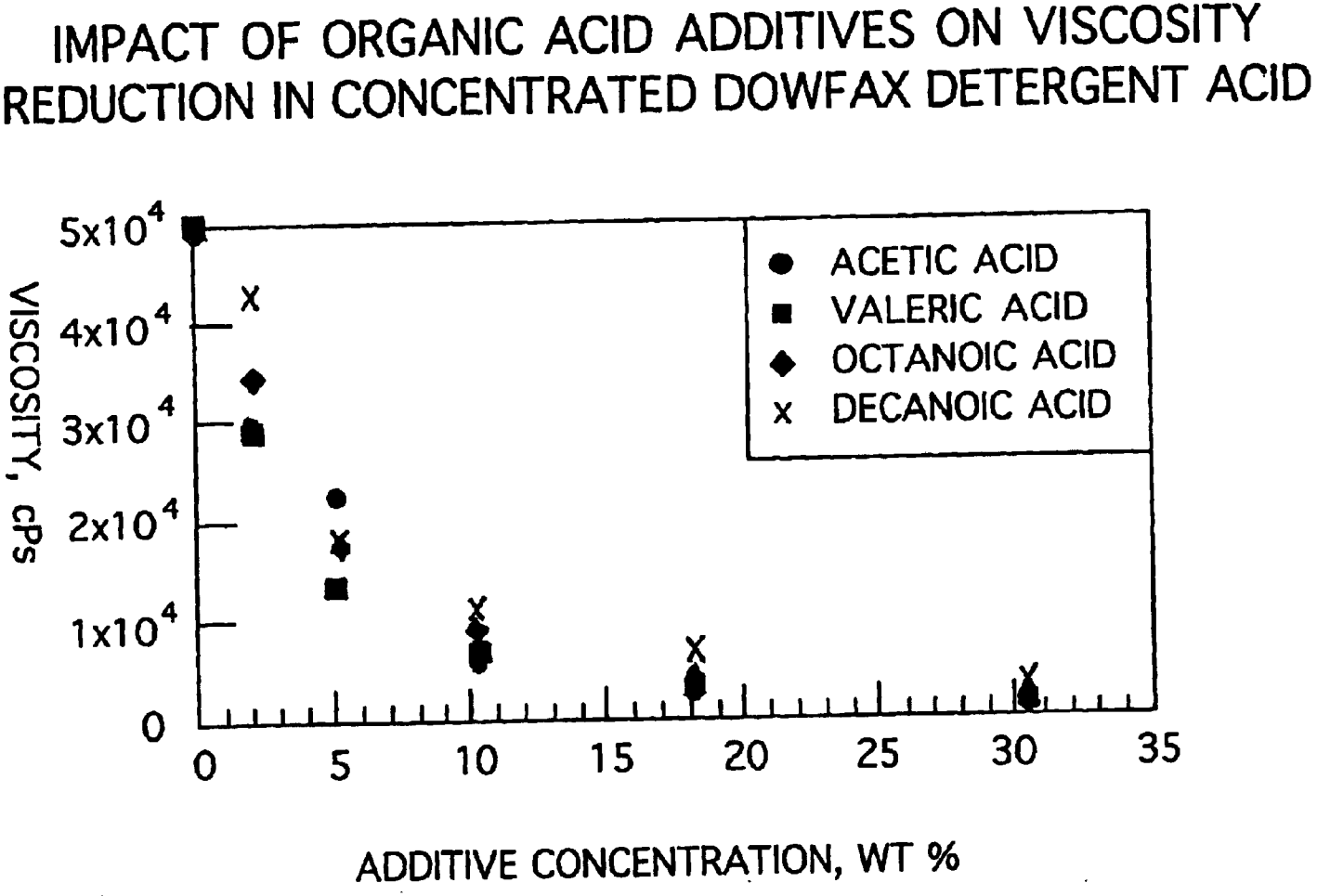
FIG. 3 shows the comparative impact of acetic, valeric, octanoic, and decanoic fatty acids on the viscosity of a DOWFAX alkyl diphenyl oxide sulfonic acid surfactant blend.

Samples containing a variety of concentrations (from 2 to 30 wt %) of four representative carboxylic acids (acetic, valeric, octanoic, and decanoic acids) each were blended with a representative alkyl diphenyl oxide sulfonic acid surfactant with a 16-carbon hydrophobe side chain (DOWFAX Detergent Acid, 94 wt % concentration). Each sample was blended until homogeneous. The viscosities of these samples were measured at 40° C. by the method indicated in Example 1. The results of these measurements are shown in FIG. 3. The behavior of DOWFAX Detergent Acid containing no carboxylic acid (at "0 wt % additive concentration" on the graph) is shown for comparison. Comparison of the data for all acids at concentrations above 0% in FIG. 3 with the 0% case help to further illustrate the general viscosity reducing influence of fatty acids on an HAA such as the tested DOWFAX Detergent Acid.

The data of FIG. 3 indicate a higher significance of fatty acid chain length toward viscosity reduction at the 5 weight percent fatty acid concentration.

EXAMPLE 4

Samples containing various ratios of either acetic or octanoic acid, as representative carboxylic acids, of a representative alkyl diphenyl oxide sulfonic acid surfactant with a 16-carbon hydrophobe side chain (DOWFAX Detergent Acid), and water were prepared. Each sample was blended until homogeneous. Gross visual examination of each sample was made to identify the presence of a solid-like, liquid crystal phase. Data defining the composition of samples exhibiting such a highly viscous phase were plotted on a ternary phase diagram to ascertain the phase boundary. Boundary regions for blends with either acetic acid or octanoic acid are shown in FIG. 4.

Figure 4:
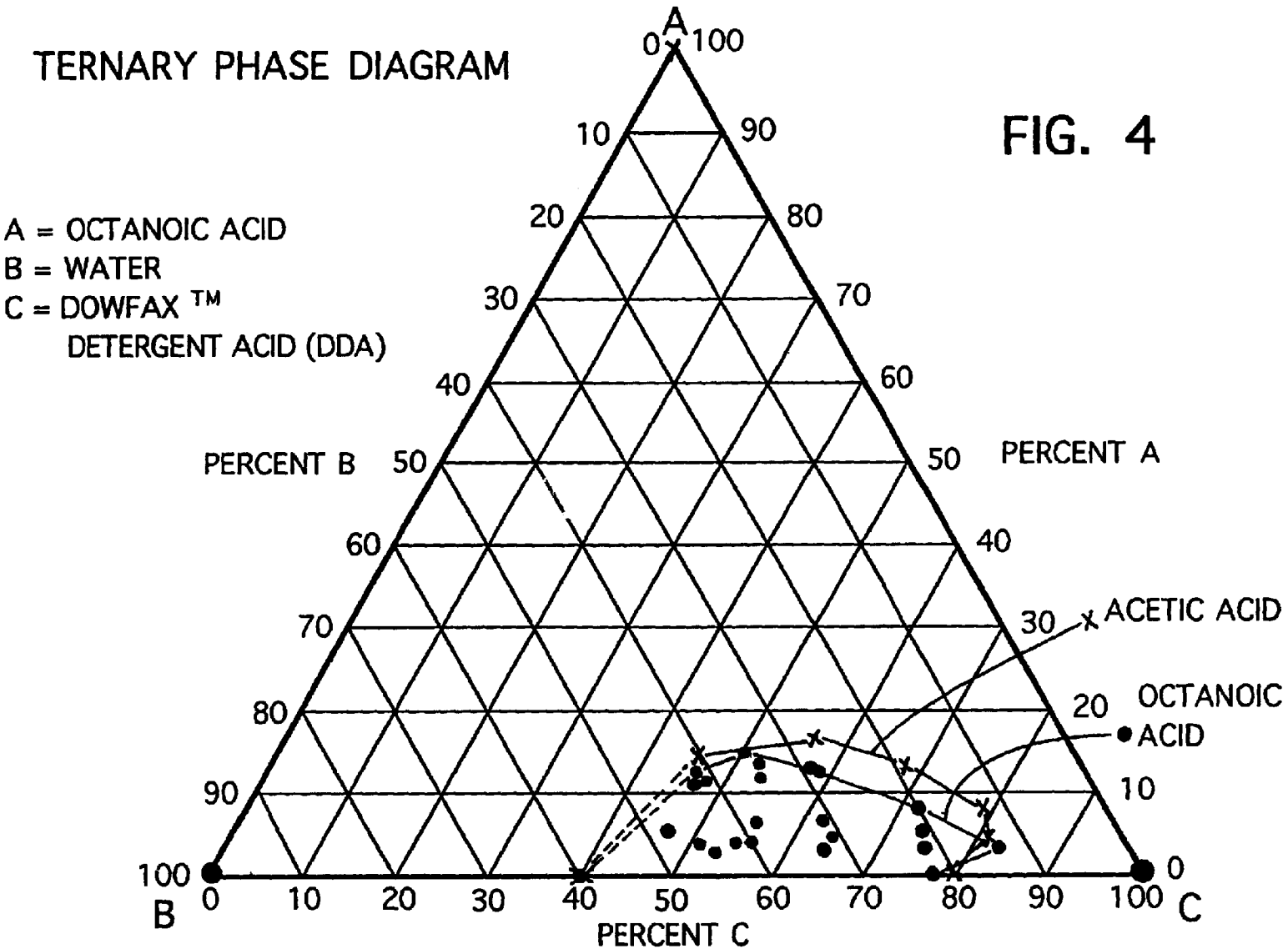
FIG. 4 shows a ternary phase diagram showing significant liquid crystal phase regions for water, DOWFAX Detergent Acid, and fatty acid (acetic acid and octanoic acid).

The ternary phase diagram of FIG. 4 shows significant liquid crystal phase regions for water, DOWFAX surfactant acid, and two fatty acids (acetic acid and octanoic acid). The phase boundary is indicated where the viscosity measures 1 million centipoise or greater at room temperature and pressure. The high viscosity area underscores the importance of the method of addition in admixing the alkyl diphenyl oxide sulfonic acid surfactant and fatty acid blend of the described embodiments with water. It should be noted successful combination of HAA with water requires attentiveness to the issue of progression in component concentration with respect to phase control according to the depiction of FIG. 4. In this regard, an alkyl diphenyl oxide sulfonic acid surfactant acid/fatty acid admixture should be added to water in use of the highly concentrated HAA in creating a surfactant for use and sale; water should not be added to the alkyl diphenyl oxide sulfonic acid surfactant acid/fatty acid admixture in use of the highly concentrated HAA in creating a surfactant for use and sale. In this regard, with reference to FIG. 4, the addition of water to the alkyl diphenyl oxide sulfonic acid surfactant acid/fatty acid admixture can function to induce substantive liquid crystal formation in the admixture and render the admixture too viscous for use since the dilution of HAA with water effects entry into the liquid crystal region.

EXAMPLE 5

Octanoic acid at a 10 weight percent concentration based upon expected levels of DOWFAX Detergent Acid was added to alkylate during a sulfonation reaction. A control reaction containing no octanoic acid under identical conditions yielded DOWFAX Detergent Acid exhibited a viscosity of 40,200 cP. The product of the sulfonation reaction containing the 10 weight percent octanoic acid had viscosity of 3,100 cP.

The beneficial results from use of fatty acids in the described embodiments indicate that fatty alcohols, fatty amines, or even linear alkanes in the $C_6$–$C_{18}$ range warrant consideration and empirical study in contemplated embodiment blends.

The present invention has been described in an illustrative manner. In this regard, it is evident that those skilled in the art, once given the benefit of the foregoing disclosure, may now make modifications to the specific embodiments described herein without departing from the spirit of the present invention. Such modifications are to be considered within the scope of the present invention and spirit of the appended claims.

We claim:

1. A method for viscosity reduction in a highly concentrated alkyl diphenyl oxide sulfonic acid blend comprising the step of:

admixing a fatty acid having a carboxylic chain length between 1 and 12 carbon atoms into the highly concentrated alkyl diphenyl oxide sulfonic acid blend to provide between about 5 weight percentage and about 50 weight percentage of fatty acid in the admixture, with the proviso that said highly concentrated alkyl diphenyl oxide sulfonic acid blend is present from 44 to 95 weight percentage in said admixture.

2. A method for preparation of a modified highly concentrated alkyl diphenyl oxide sulfonic acid blend comprising the steps of:

admixing a fatty acid selected from the group consisting of formic acid, acetic acid, propionic acid, butanoic acid, pentanoic acid, valeric acid, hexanoic acid, heptanoic acid, octanoic acid, nonanoic acid, decanoic acid, undecanoic acid, and dodecanoic acid to provide between about 5 weight percentage and about 50 weight percentage of fatty acid in an admixture with 44 to 95 wt. % of an alkyl diphenyl oxide sulfonic acid blend comprising

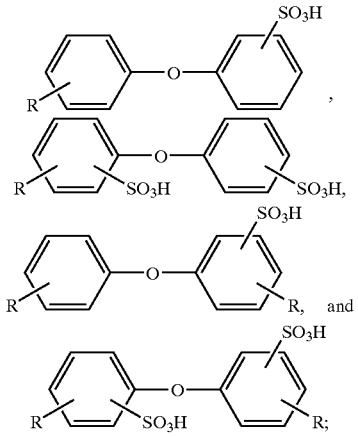

where R is an alkyl radical having between 6 and 16 carbon atoms.

3. The method of claim 2 wherein a plurality of said fatty acids are admixed in said admixing step with said alkyl diphenyl oxide sulfonic acid blend.

4. The method of either claims 2 or 3 wherein the alkyl diphenyl oxide sulfonic acid blend prior to admixing of said fatty acid comprises:

between about 5 to about 25 weight percent

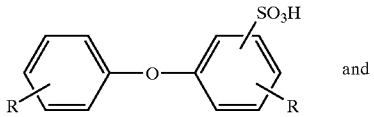

-continued

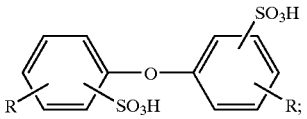

between about 75 to about 95 respective weight percent

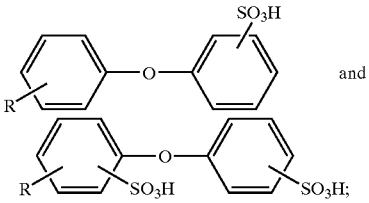

and with the proviso that the combined concentration of

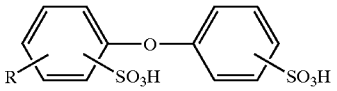

and

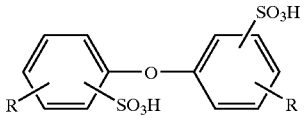

is greater that 85 weight percent.

5. A method for preparation of a surfactant comprising the steps of:

admixing a fatty acid selected from the group consisting of formic acid, acetic acid, propionic acid, butanoic acid, pentanoic acid, valeric acid, hexanoic acid, heptanoic acid, octanoic acid, nonanoic acid, decanoic acid, undecanoic acid, dodecanoic acid to provide between about 5 weight percentage and about 50 weight percentage of fatty acid in admixture with 44 to 95 weight percentage of an alkyl diphenyl oxide sulfonic acid blend comprising between about 5 to about 25 weight percent

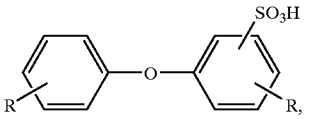

and

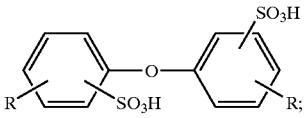

between about 75 to about 95 respective weight percent

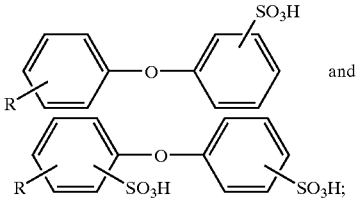

and with the proviso that the combined concentration of

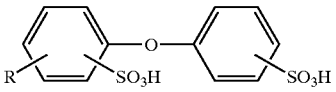

and

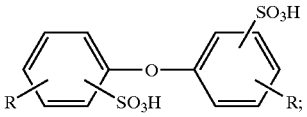

is greater that 85 weight percent;

blending the sulfonated admixture into water; and neutralizing the blend of water and sulfonated admixture;

where R is an alkyl radical between 6 and 16 carbon atoms.

* * * * *